US007470155B1

(12) United States Patent
Soubh et al.

(10) Patent No.: US 7,470,155 B1
(45) Date of Patent: Dec. 30, 2008

(54) HIGH-DENSITY CONNECTOR

(75) Inventors: Emad Soubh, Camas, WA (US); Steve Koopman, Floyds Knobs, IN (US)

(73) Assignee: Samtec, Inc., New Albany, IN (US)

( * ) Notice: Subject to any disclaimer, the term of this patent is extended or adjusted under 35 U.S.C. 154(b) by 0 days.

(21) Appl. No.: 11/782,896

(22) Filed: Jul. 25, 2007

(51) Int. Cl.
*H01R 13/502* (2006.01)

(52) U.S. Cl. ..... 439/701; 439/579; 439/608

(58) Field of Classification Search ..... 439/579, 439/608, 701
See application file for complete search history.

(56) References Cited

U.S. PATENT DOCUMENTS 4,913,662 A * 4/1990 Noy ..... 439/498
5,411,415 A * 5/1995 Embo et al. ..... 439/610
5,477,518 A * 12/1995 Hiatt ..... 720/654
6,142,835 A * 11/2000 Daoud ..... 439/709
6,857,912 B2 * 2/2005 Wu ..... 439/701
7,101,188 B1 * 9/2006 Summers et al. ..... 439/59
7,255,578 B2 * 8/2007 Campini et al. ..... 439/79
7,445,471 B1 * 11/2008 Scherer et al. ..... 439/108
2004/0164754 A1 * 8/2004 Holcombe et al. ..... 324/754
2005/0079772 A1 * 4/2005 DeLessert ..... 439/700
2005/0122701 A1 * 6/2005 Coffey ..... 361/796
2006/0223343 A1 * 10/2006 Campini et al. ..... 439/64

OTHER PUBLICATIONS

Soubh et al.; "Probe Having a Filed-Replaceable Tip"; U.S. Appl. No. 11/668,455, filed Jan. 29, 2007.

* cited by examiner

*Primary Examiner*—James Harvey
(74) *Attorney, Agent, or Firm*—Keating & Bennett, LLP

(57) ABSTRACT

A high-density connector assembly includes a frame, at least one sub-assembly connected to the frame, at least one connector connected to the at least one sub-assembly, a plurality of contacts disposed in the connector, a circuit board disposed in the connector; and a plurality of cables. Each of the plurality of cables is connected to a corresponding one of the plurality of contacts. At least one of the plurality of contacts has a bifurcated tip.

18 Claims, 10 Drawing Sheets

HIGH-DENSITY CONNECTOR

BACKGROUND OF THE INVENTION

1. Field of the Invention

The present invention relates to high-density connectors. More specifically, the present invention relates to modular, high-density connectors for use with automatic testing equipment.

2. Description of the Related Art

It is known in the field of automatic testing equipment to use high-density connectors to test, for example, semiconductor die wafers, RAM, and DRAM. In the process of testing the semiconductor die, a mating circuit board must be provided in order to route the connections of the semiconductor die so that the connections are less dense because of the very high density of the connections on the semiconductor die, which may comprise at least 13,000 connections and up to 48,000 connections. In this way, semiconductor dies can be tested to see if they are operating properly. However, the density of the connections on the mating circuit board is still very high.

One known connector used with automatic testing equipment includes a sub-connector that has pogo pins soldered to both sides of a circuit board. The sub-connectors are arranged into an array to form the connector. Pogo pins include a socket, a pin that is partially disposed in the socket, and a spring disposed in the socket that pushes the pin away from the socket. This arrangement of pogo pins allows the pins to travel within the socket. Pogo pins suffer from several drawbacks. First, the pogo pins are relatively long. Because pogo pins are relatively long, it is difficult to design a compact connector. Also, pogo pins are more likely to have impedance discontinuities and to have more attenuation. Second, pogo pins are expensive because of the difficulties in their manufacturing. Third, the total downward force required to engage all of the pogo pins with the mating circuit board is quite large. Fourth, it is difficult to ensure proper impedance matching of the connector. Fifth, pogo pins have a relatively low density.

Another known connector used with automatic testing equipment includes an array of compression contacts that must be compressed from the top and the bottom when the connector is engaged with the mating circuit board. The problem with this connector is that it takes an extremely large downward force to ensure proper connection of the compression contacts with the mating circuit board. The lifetime of this connector includes a relatively low number of mating cycles. Further, the connector must be mated for a fixed time period before proper operation can be ensured.

Each of these known connectors is also not field-replaceable. Because the connector is not field-replaceable, the entire connector must be sent back to the manufacturer to replace and calibrate the connector when the connector is defective, damaged, or malfunctioning. To replace the connector, the connector must be either de-soldered or broken off from the cables attached to the connector. This is a costly and time-consuming process.

SUMMARY OF THE INVENTION

To overcome the problems described above, preferred embodiments of the present invention provide a high-density connector assembly and a testing assembly. The high-density connector assembly includes a frame, at least one sub-assembly connected to the frame, at least one connector connected to the at least one sub-assembly, a plurality of contacts disposed in each of the at least one connector, at least one circuit board disposed in each of the at least one connector, and a plurality of cables, where each of the plurality of cables is connected to a corresponding one of the plurality of contacts. One of, or both of, the at least one connector and the at least one sub-assembly is field-replaceable.

Preferably, some of the plurality of contacts are connected to a ground plane provided in or on the at least one circuit board. At least one of the plurality of contacts preferably has a bifurcated tip. The plurality of contacts are preferably connected to the at least one circuit board. The at least one sub-assembly preferably includes at least one peg. Preferably, the at least one connector is connected to the at least one peg by a fixing pin. The at least one peg is preferably inserted into a corresponding at least one hole in the frame.

The plurality of contacts is preferably arranged in at least one row. Within each of the at least one row, one of the plurality of contacts that is connected to the ground plane is preferably arranged between adjacent ones of the plurality of contacts that are connected to the corresponding one of the plurality of cables. The frame is preferably divided into at least two sections, and the plurality of cables is preferably divided into groups corresponding to the at least two sections.

Preferably, the at least one connector has a hole at one end and a slot at the other end. The at least one connector preferably includes at least two connectors and an even number of connectors, and the even number of at least two connectors is preferably arranged such that the slots of each of the even number of at least two connectors are directly adjacent each other. Each of the at least one connector preferably includes four rows of contacts.

Preferably, the at least one circuit board preferably includes two circuit boards. One of the two circuit boards is disposed between two of the four rows of contacts, and the other of the two circuit boards is disposed between the other two of the four rows of contacts. The at least one sub-assembly preferably includes four sub-assemblies, and the at least one connector preferably includes two connectors. Each of the plurality of cables is preferably soldered to the at least one circuit board. Each of the plurality of contacts preferably includes a finger portion, and the finger portion of each of the plurality of contacts is preferably connected to the at least one circuit board. Each of the plurality of cables preferably includes a ground sheath.

The testing assembly includes a high-density connector assembly according to another preferred embodiment of the present invention, testing equipment connected to the high-density connector assembly, and a device to be tested. The testing assembly preferably includes a mating circuit board connected to the device to be tested and the high-density connector assembly.

Other features, elements, steps, features, characteristics and advantages of the present invention will become more apparent from the following detailed description of preferred embodiments of the present invention with reference to the attached drawings.

DETAILED DESCRIPTION OF PREFERRED EMBODIMENTS

Figure 1A:
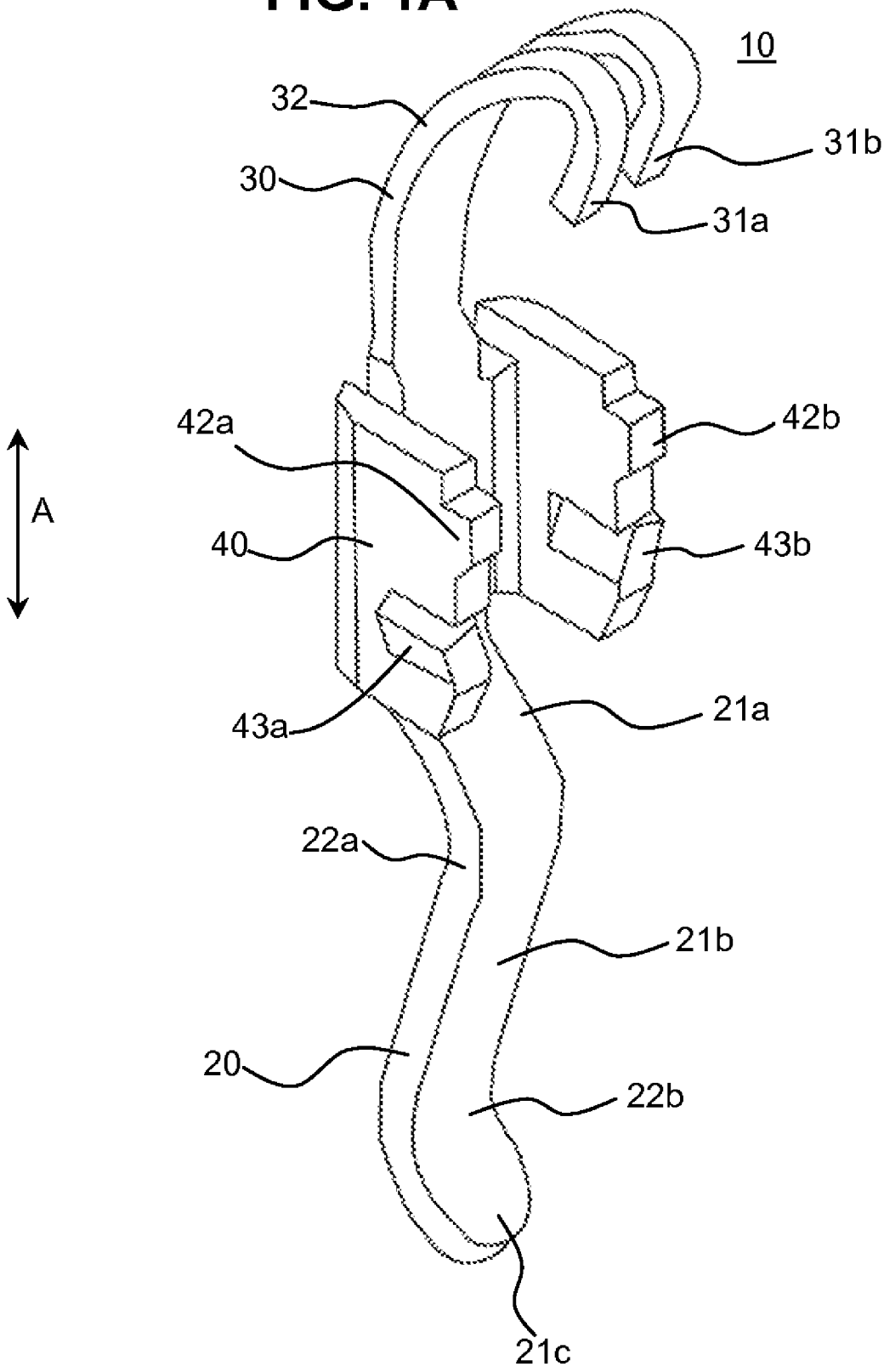
FIG. 1A is a perspective view of a contact according to a preferred embodiment of the present invention.
Figure 1D:
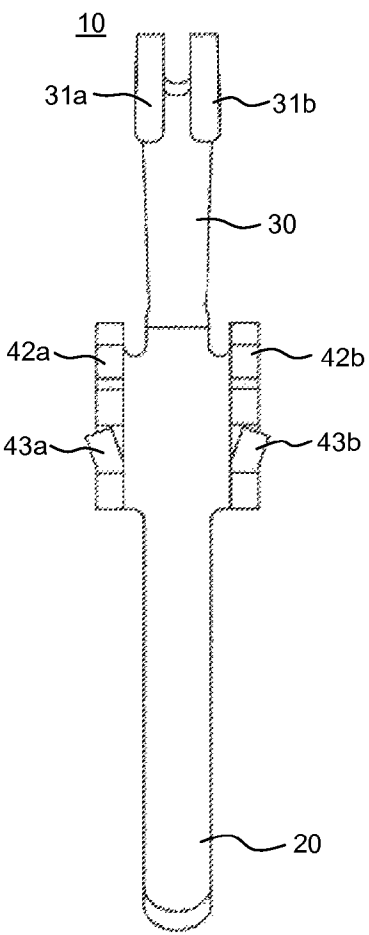
FIGS. 1B, 1C, and 1D are rear, side, and front views, respectively, of a contact according to a preferred embodiment of the present invention.
Figure 1C:
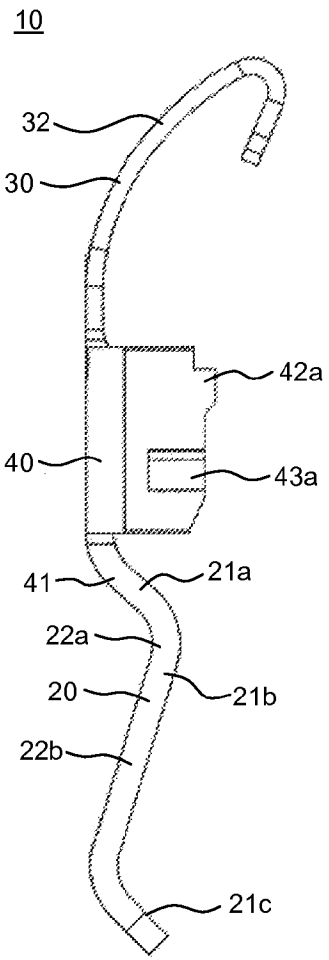
Figure 1B:
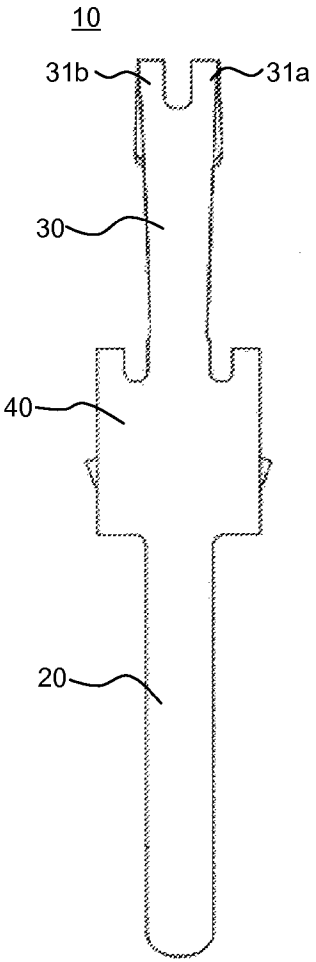

The preferred embodiments of the present invention are discussed below with respect to the figures. First, a contact according to a preferred embodiment of the present invention that is preferably used in a high-density connector assembly according to a preferred embodiment of the present invention is discussed. Second, a connector according to a preferred embodiment of the present invention is discussed. Third, a connector sub-assembly according to a preferred embodiment of the present invention is discussed. Fourth, a high-density connector assembly according to a preferred embodiment of the present invention is discussed.

Contact for Use in a High-Density Connector Assembly

FIGS. 1A-1D and 2 show the contact 10 according to a preferred embodiment of the present invention. Contact 10 includes a finger portion 20, a curl portion 30, and a retention portion 40. The finger portion 20 extends from one end of the retention portion 40, and the curl portion 30 extends from the other end of the retention portion 40. Preferably, the contact 10 is of unitary construction. The contact 10 is preferably formed of a copper alloy, such as beryllium copper or phosphor bronze, or other suitable conductive material.

The finger portion 20 of the contact is used to make contact with an electrical land 51 on a circuit board 50. The finger portion 20 is arranged such that, when the finger portion 20 is in contact with the electrical land 51 of the circuit board 50, the major surfaces 50*a* and 50*b* of the circuit board 50 are generally parallel to direction A, which extends in the length direction of the contact 10. Typically, two rows of contacts 10 are arranged in opposing positions such that, when a circuit board 50 is inserted between the two rows of contacts 10, the finger portions 20 of the contacts 10 make contact with the corresponding electrical lands 51 on both major surfaces 50*a* and 50*b* of the circuit board 50.

Preferably, the finger portions 20 include three straight portions 21*a*, 21*b*, and 21*c* and two bent portions 22*a* and 22*b*. Straight portion 21*a* and straight portion 21*b* extend from opposing ends of bent portion 22*a*, and straight portion 21*b* and straight portion 21*c* extend from opposing ends of bent portion 22*b*.

The finger portion 20 extends from the retention portion 40 at bent portion 41. Bent portion 41 and bent portion 22*a* are arranged such that the finger portion 20 acts as a spring whose force is acting in a direction towards the circuit board 50. The bent portion 22*b* of the finger portion 20 makes direct contact with a corresponding electrical land 51 on the circuit board 50. Contact between the bent portion 22*b* and electrical land 51 is consistently and reliably maintained because of the spring action generated by the arrangement of the bent portion 41 and the bent portion 22*a*. When the contacts 10 are arranged in two opposing rows, the opposing straight portions 21*c* of the two rows of contacts 10 guide the circuit board 50 in between the contacts 10.

The curl portion 30 of the contact 10 is used to make contact with an electrical land 61 on a circuit board 60. As opposed to the arrangement of the finger portion 20 of the contact 10 discussed above, the curl portion 30 is arranged such that, when the curl portion 30 is in contact with the electrical land 61 of the circuit board 60, the major surfaces 60*a* and 60*b* of the circuit board 60 are generally perpendicular to the direction A. Typically, the contacts 10 of a single connector are arranged such that all of the curl portions 30 of the contacts 10 make mechanical and electrical contact with the corresponding electrical lands 61 on the same surface of the circuit board 60.

The curl portion 30 includes a curved portion 32. One end of the curved portion 32 is connected to the retention portion 40. The other end of the curl portion 30 of the contact 10 includes bifurcated tips 31*a* and 31*b*. The bifurcated tips 31*a* and 31*b* make contact with the electrical lands 61 of the circuit board 60. The bifurcated tips 31*a* and 31*b* provide redundant contact points for the current to flow from the electrical lands 61 to the contact 10, which improves the electrical properties of the circuit that includes the contact 10, e.g., lowers the resistance. Further, the contact wipe (i.e., the removal of an oxide layer on the electrical lands 61 by the contacts) of the electrical land 61, when the bifurcated tips 31*a* and 31*b* come into contact with the electrical land 61, also improves the electrical properties of the circuit that includes the contact 10 by ensuring a reliable connection between the contact 10 and the electrical land 61 because it provides a larger and better wipe of the electrical lands 61. The bifurcated tips 31*a* and 31*b* also provide an electrical connection to the circuit board 60 even if one of the bifurcated tips 31*a* or 31*b* is not connected.

The retention portion 40 of the contact 10 includes several retention features for securing the contact 10 in the housing of a connector. The retention portion 40 includes blocks 42*a* and 42*b* and lances 43*a* and 43*b*, all of which are retention features. The blocks 42*a* and 42*b* and the lances 43*a* and 43*b* act in cooperation to secure the contact 10 in the housing of a connector 70. Blocks 42*a* and 42*b* oppose each other and secure the contact 10 in a first direction, and lances 43*a* and 43*b* oppose each other and secure the contact 10 in a second direction perpendicular or substantially perpendicular to the first direction. Lances 43*a* and 43*b* also secure the contact 10 from being pulled out of the connector housing.

Contact 10 can have a different arrangement of retention features or have different retention features than those described above. For example, the contact 10 could use (1) only blocks 42*a* and 42*b*; (2) only lances 43*a* and 43*b*; (3) one block 42*a* or 42*b* and one lance 43*a* or 43*b*; or (4) any other suitable arrangement. Also, instead of lances 43*a* and 43*b*, the contact 10 can have different retention features such as a hemispherical boss or other suitable retention features. The retention features of the contact 10 should be arranged such that the contact 10 is securely retained within the connector housing.

Figure 2:
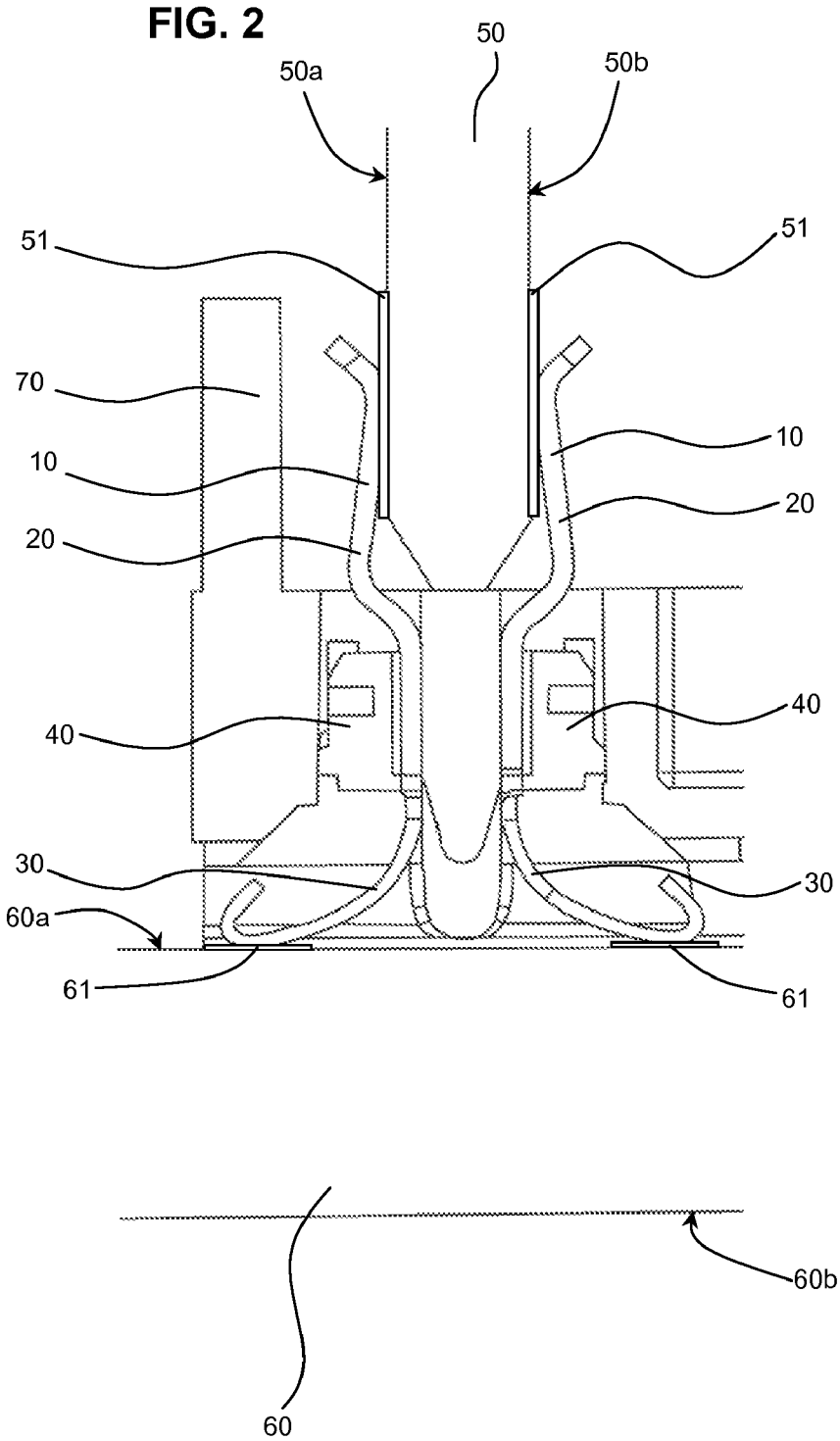
FIG. 2 is a close-up sectional view of a contact according to a preferred embodiment of the present invention in an electrical connector.

The arrangement of the contacts 10 in the connector 70 shown in FIG. 2 is illustrative of one arrangement of the contacts 10. Other arrangements of the contacts 10 in the connector 70 are also possible. For example, instead of two rows of contacts 10, the connector 70 could be arranged to have one row of contacts 10 or to have three or more rows of contacts 10.

Connector for a High-Density Connector Assembly

Figure 3A:
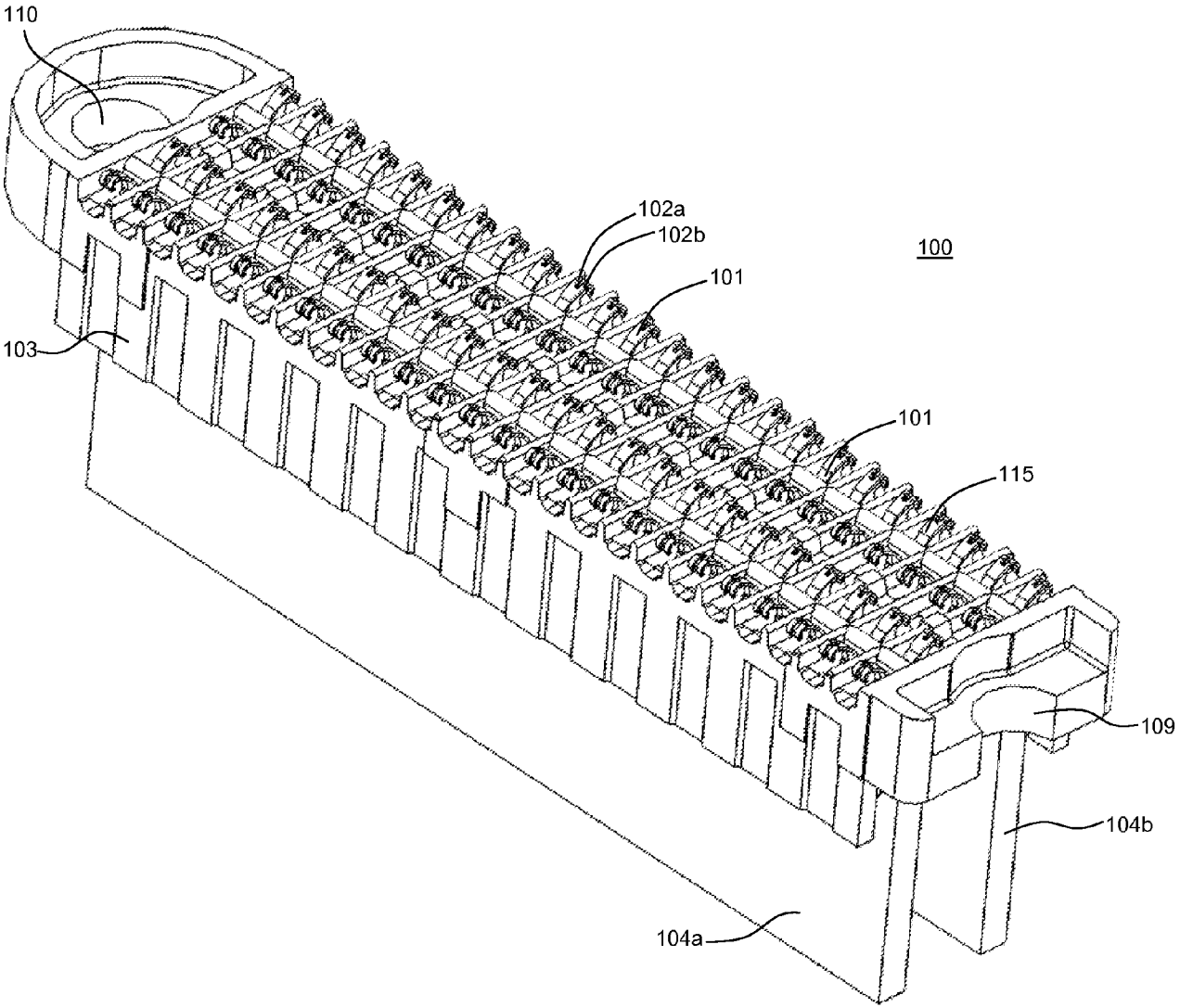
FIG. 3A is perspective view of a connector according to a preferred embodiment of the present invention.
Figure 3B:
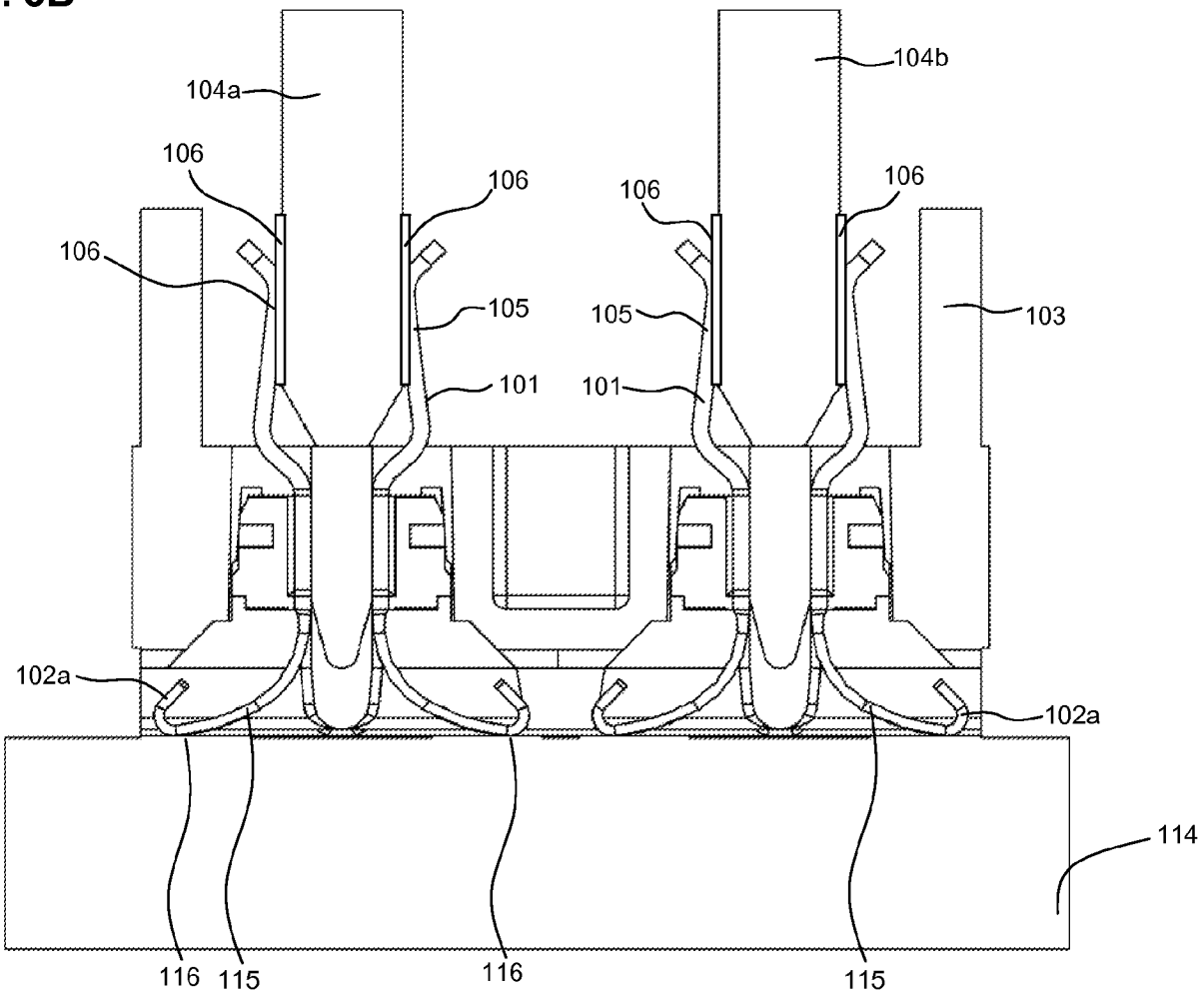
FIG. 3B is a close-up sectional view of a connector according to a preferred embodiment of the present invention.
Figure 3C:
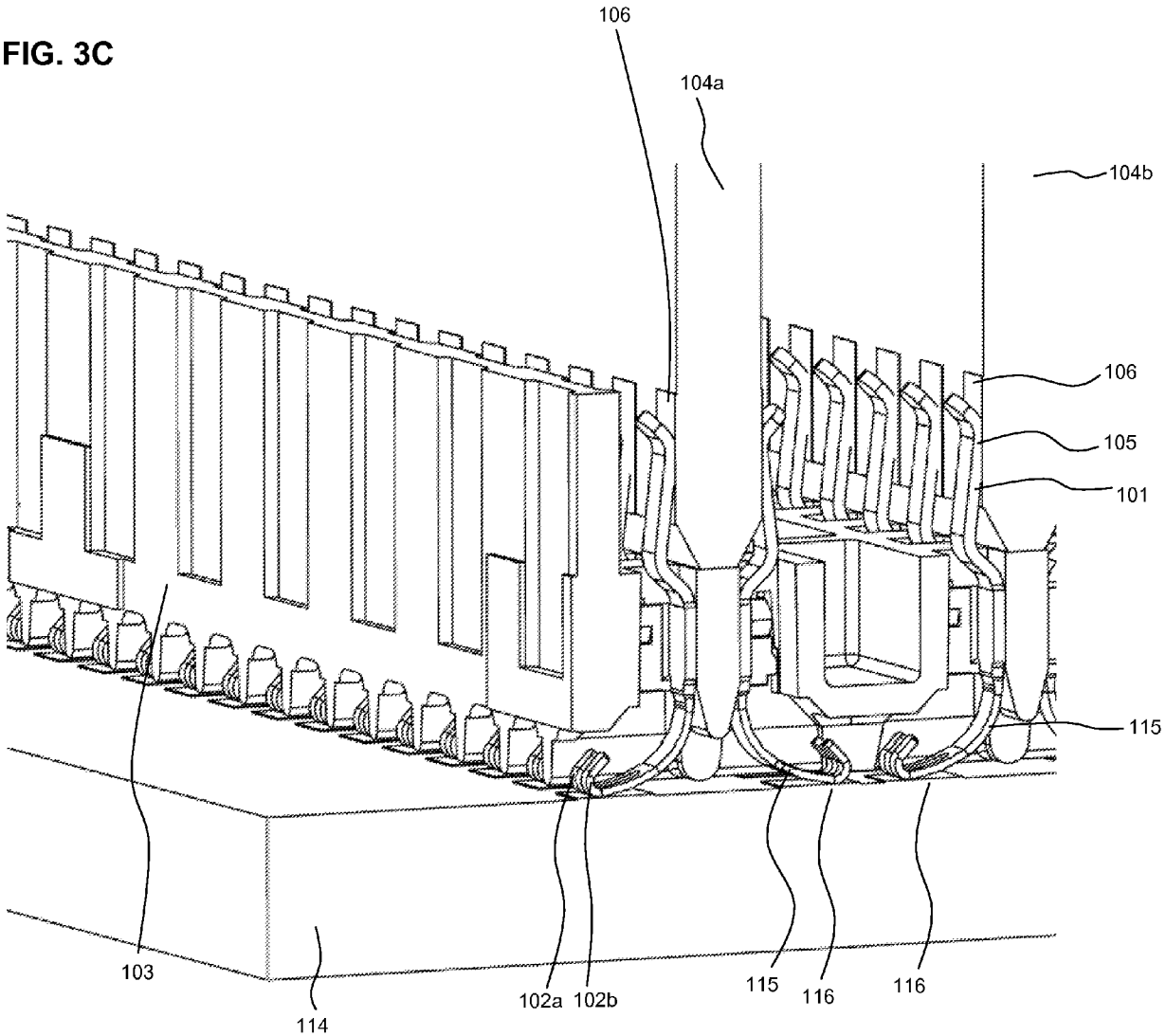
FIG. 3C is a close-up perspective view of a section of a connector according to a preferred embodiment of the present invention.

FIGS. 3A-3C show a connector 100 according to another preferred embodiment of the present invention. Connector 100 is the basic modular element used to form the high-density connector assembly 300, which is discussed below with respect to FIGS. 5A-5C. Two connectors 100 are preferably used in the connector sub-assembly 200, which is discussed below with respect to FIG. 4, and four connector sub-assemblies 200 are preferably used in the high-density connector assembly 300.

The connector 100 shown in FIGS. 3A-3C includes a housing 103 that preferably has four rows of contacts 101, for example. Preferably, contacts 101 are the same as contact 10 discussed above. However, it is possible that other types of contacts could be used. When contacts 10 are used as the contacts 101, the downward force required to mate the high-density connector assembly 300 with a mating circuit board 114 is relatively small, and the electrical stub length of the high-density connector assembly 300 is relatively small.

The curl portion 115 of the contact 101 includes bifurcated tips 102*a* and 102*b*. The curl portion 115 of the contact 101 is the portion of the contact 101 that contacts the electrical lands 116 of the mating circuit board 114. The bifurcated tips 102*a* and 102*b* of the contacts 101 create redundant current paths for the electrical signals from the electrical lands 116 of the mating circuit board 114, which allows a reliable connection to be formed between the electrical lands 116 of the mating circuit board 114 and the contacts 101.

A circuit board 104*a* is inserted between two of the rows of contacts 101, and a circuit board 104*b* is inserted between the other two rows of contacts 101. The circuit boards 104*a* and 104*b* are inserted between the rows of contacts 101 such that the finger portions 105 of the contacts 101 contact the electrical lands 106 on both sides of the circuit boards 104*a* and 104*b*. Although the connector 100 shown in FIGS. 3A-3C preferably has four rows of contacts 101, it is possible to use a connector having one, two, or three rows of contacts 101 or having five or more rows of contacts 101.

Some of the contacts 101 are connected to a corresponding cable 108 (not shown in FIGS. 3A-3C, but shown in FIGS. 4, 5A, and 5B), and some of the contacts 101 are connected to a ground plane 113 (not shown in FIGS. 3A-3C, but shown in FIGS. 4, 5A, and 5B) on the circuit boards 104*a* and 104*b*. This will be discussed in detail below with respect to the sub-assembly 200 shown in FIG. 4.

Connector 100 preferably has two retention features, slot 109 and hole 110, that secure the connector 100 in sub-assembly 200. In FIGS. 3A-3C, the slot 109 is semi-circular or substantially semi-circular, and the hole 110 is circular or substantially circular. However, the slot 109 and the hole 110 can have any other suitable shape. For example, the slot 109 and the hole 110 can be square, substantially square, rectangular, or substantially rectangular.

Two connectors 100 are preferably provided in the connector sub-assembly 200. The connector sub-assembly 200 and the assembly of the connector sub-assembly 200 are discussed in detail below.

Connector Sub-Assembly for a High-Density Connector Assembly

Figure 4:
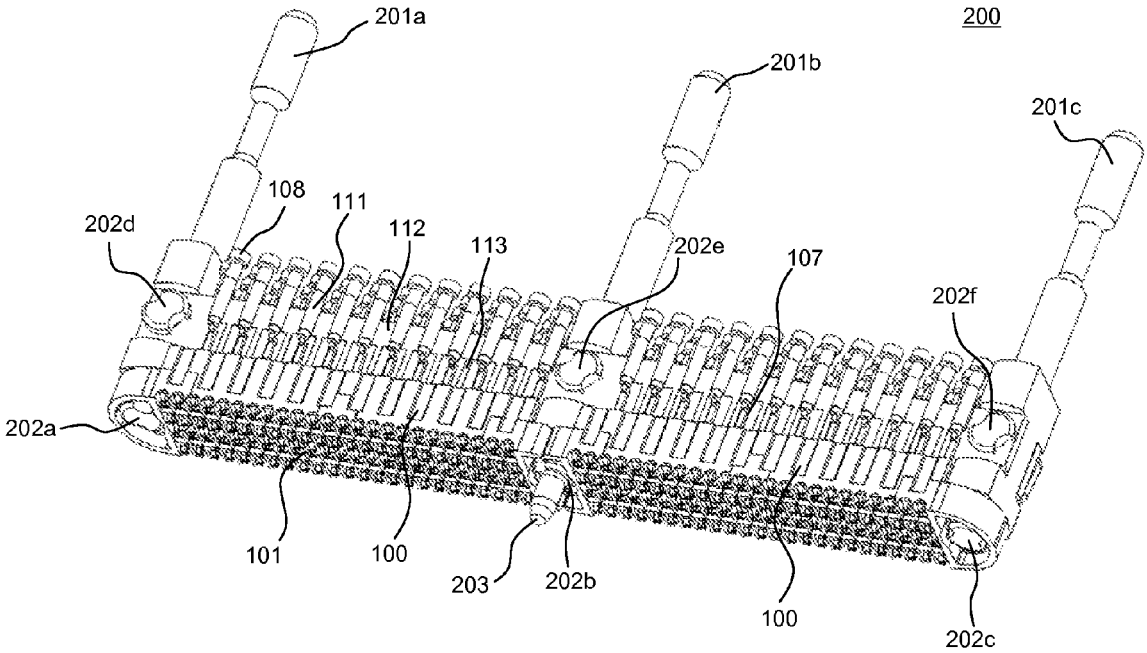
FIG. 4 is a perspective view of a connector sub-assembly according to a preferred embodiment of the present invention.

FIG. 4 shows the sub-assembly 200 according to a preferred embodiment of the present invention. Sub-assembly 200 includes two of the connectors 100 and three pegs 201*a*, 201*b*, and 201*c*.

The pegs 201*a* and 201*b* are connected to one of the two connectors 100, and the pegs 201*b* and 201*c* are connected to the other of the two connectors 100. The pegs 201*a* and 201*c* engage the holes 110 of the respective connector 100. The two connectors 100 are arranged such that the end of the connectors 100 with the holes 110 are at opposites ends of the connector sub-assembly 200, and the two connectors 100 are arranged such that that the end of the connectors 100 with the slots 109 are directly adjacent to each other such that a circular hole or a substantially circular hole is formed by the slots 109.

Pegs 201*a* and 201*c* are secured to the respective connector 100 by inserting fixing pins 202*a* and 202*c* through the holes 110 in the respective connectors 100 into holes (not shown) in the bottom of the pegs 201*a* and 201*c*. Peg 201*b* is secured to the two connectors 100 by inserting a fixing pin 202*b* into the circular hole or substantially circular hole formed by the slots 109 of the connectors 100.

Preferably, as shown in FIG. 4, the circuit boards 104*a* and 104*b* are also secured to the pegs 201*a*, 201*b*, and 201*c*. Each of the circuit boards 104*a* and 104*b* (circuit board 104*b* is not shown in FIG. 4 but is secured to the pegs 201*a*, 201*b*, and 201*c* in a similar manner as circuit board 104*a*) are secured to the pegs 201*a*, 201*b*, and 201*c* by inserting fixing pins 202*d*, 202*e*, and 202*f* through the circuit boards 104*a* and 104*b* into holes (not shown) in the pegs 201*a*, 201*b*, and 201*c*. FIG. 4 shows that the two connectors 100 of the connector sub-assembly 200 preferably share common circuit boards 104*a* and 104*b*, i.e., the connector sub-assembly 200 only includes one circuit board 104*a* and one circuit board 104*b*. However, it is possible that each of the two connectors 100 of the connector sub-assembly 200 includes separate circuit boards 104*a* and 104*b*, i.e., the connector sub-assembly 200 includes two circuit boards 104*a* and two circuit boards 104*b*. Further, instead of using a single circuit board 104*a* or 104*b* for a pair of the rows of contacts 101, it is also possible to use multiple circuit boards for the pair of rows of contacts 101.

The fixing pins 202*a*, 202*b*, 202*c*, 202*d*, 202*e*, and 202*f* are preferably threaded so that the fixing pins 202*a*, 202*b*, 202*c*, 202*d*, 202*e*, and 202*f* can be screwed into the pegs 201*a*, 201*b*, and 201*c* to secure the two connectors 100 and the circuit boards 104*a* and 104*b* to the pegs 201*a*, 201*b*, and 201*c*. This arrangement allows the connectors 100, including the circuit boards 104*a* and 104*b*, to be field-replaceable because the fixing pins 202*a*, 202*b*, 202*c*, 202*d*, 202*e*, and 202*f* can be unscrewed from the pegs 201*a*, 201*b*, and 201*c* in the field, without having to send the entire high-density connector assembly 300 back to the manufacturer or repair facility. This arrangement also allows for only one connector 100 to be replaced, instead of the entire high-density connector assembly 300 being replaced. Instead of using fixing pins 202*a*, 202*b*, 202*c*, 202*d*, 202*e*, and 202*f*, it is also possible to use other methods of securing the two connectors 100 and the circuit boards 104*a* and 104*b* to the pegs 201*a*, 201*b*, and 201*c* to make the connectors 100 field-replaceable.

In FIG. 4, two connectors 100 are preferably provided in the connector sub-assembly 200. However, it is possible to use a single connector 100 or to use three or more connectors 100. Also, it is possible to use different methods to secure the connectors 100 to the pegs 201*a*, 201*b*, and 201*c*.

FIG. 4 shows that the fixing pin 202*b* includes an alignment protrusion 203. As seen in FIGS. 5B and 5C, it is possible that one or more of the fixing pins 202*a* and 202*c* also include alignment protrusions 203. The alignment protrusions 203 are used in combination with alignment holes (not shown) in the mating circuit board 114 to ensure the proper alignment of the high-density connector assembly 300 with respect to the mating circuit board 114. It is possible to use other arrangements of the alignment protrusions 203 to ensure the proper alignment of the high-density connector assembly 300 with respect to the mating circuit board 114 instead of the arrangement of the alignment protrusions 203 shown in FIGS. 4, 5B, and 5C.

As discussed above, some of the contacts 101 are connected to a corresponding cable 108, and some of the contacts 101 are connected to the ground plane 113 on the circuit boards 104*a* and 104*b*. The contacts 101 that are connected to the ground plane 113 improve the signals transmitted through contacts 101 that are connected to a corresponding cable 108 by reducing the cross-talk between adjacent contacts 101 that are connected to a corresponding cable 108 because of the closeness of the ground return path. In FIG. 4, each of the connectors 100 preferably has four rows of cables 108, with 12 cables per row, for example. That is, each connector 100 is connected to forty-eight cables 108. However, it is possible to use a different number of cables 108 per row or to use rows in which none of the rows has the same number of cables 108. Also, it is possible to add passive elements or active elements, or both, to the circuit boards 104*a* and 104*b* shown in FIGS. 3A-3C in order to change the electrical characteristics of the high-density connector assembly 300.

Preferably, in a single row of contacts 101, a contact 101 that is connected to the ground plane 113 is arranged between each adjacent contacts 101 that are connected to a corresponding cable 108. Also preferably, between adjacent rows of contacts 101, the contacts 101 of adjacent rows are arranged such that, in a top plan view, the array of the contacts 101 that are connected to the ground plane 113 and of the contacts 101 that are connected to a corresponding cable 108 are staggered to form a checkerboard pattern such that contacts 101 that are adjacent, either in the same row or in an adjacent row, to a contact 101 that is connected to a corresponding cable 108 are connected to the ground plane 113.

It is possible to have different arrangements of the contacts 101 that are connected to the ground plane 113 and of the contacts 101 that are connected to a corresponding cable 108. For example, it is possible to use more contacts 101 that are connected to the ground plane 113 so that there is at least two contacts 101 that are connected to the ground plane 113 between adjacent contacts 101 that are connected to corresponding cables 108, and it is possible to use less contacts 101 that are connected to the ground plane 113 so that there is a contact 101 that is connected to the ground plane 113 between each adjacent pair of contacts 101 that are connected to a corresponding cable 108.

The electrical lands 107 (not shown in FIGS. 3A-3C, but shown in FIG. 4) that are connected to a cable 108 are connected to some of the electrical lands 106 by traces on the circuit boards 104*a* and 104*b*. Preferably, the cables 108 are connected to the electrical lands 107 by soldering. However, any other suitable method can be used to connect the cables 108 to the electrical lands 107.

Figure 5A:
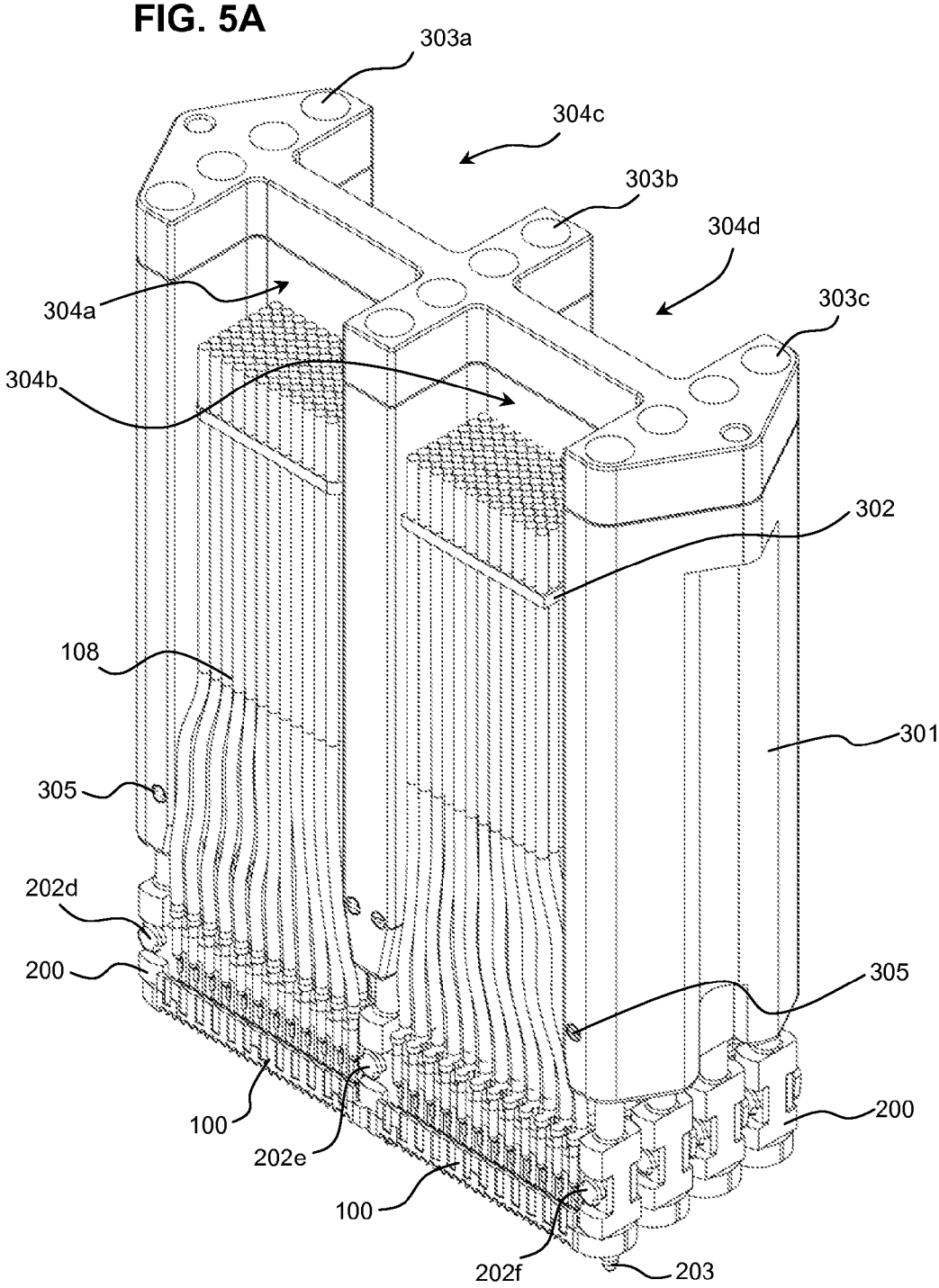
FIGS. 5A and 5B are top and bottom perspective views, respectively, of a high-density connector assembly according to a preferred embodiment of the present invention.
Figure 5B:
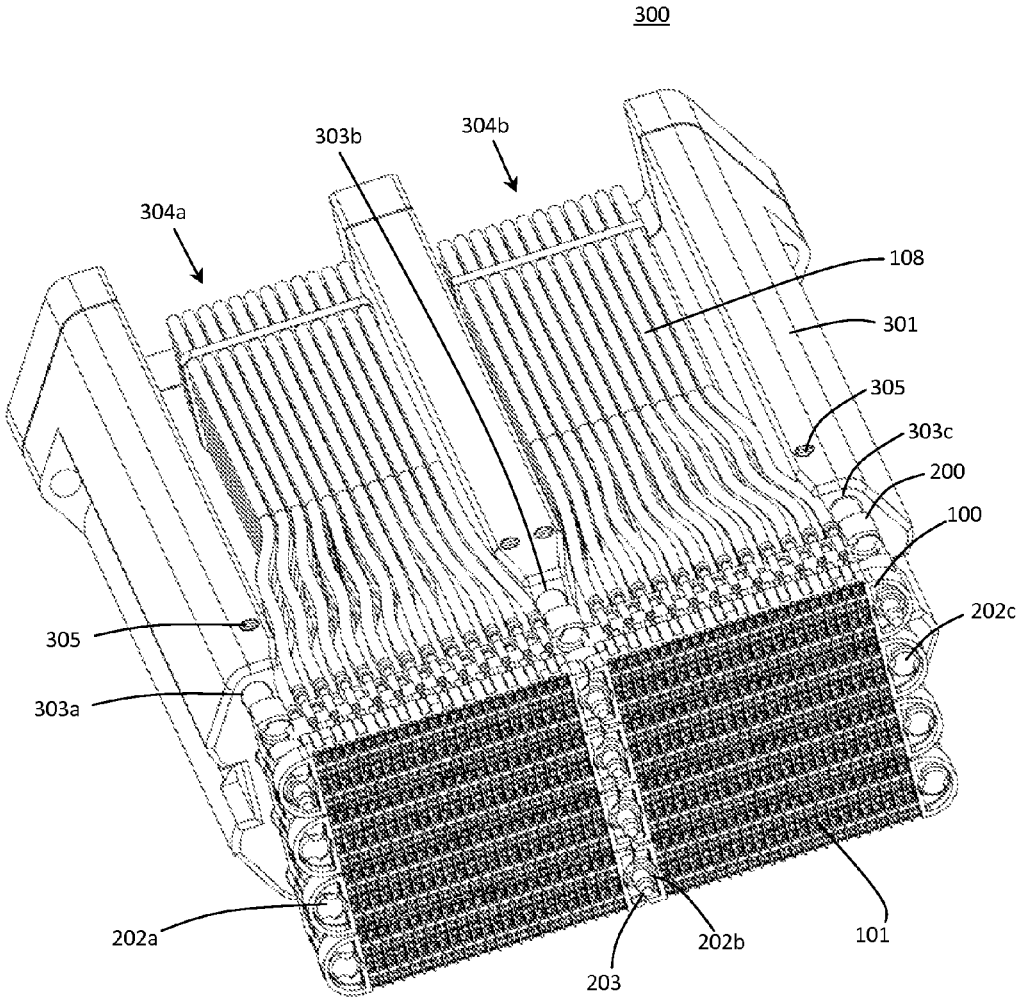
Figure 5C:
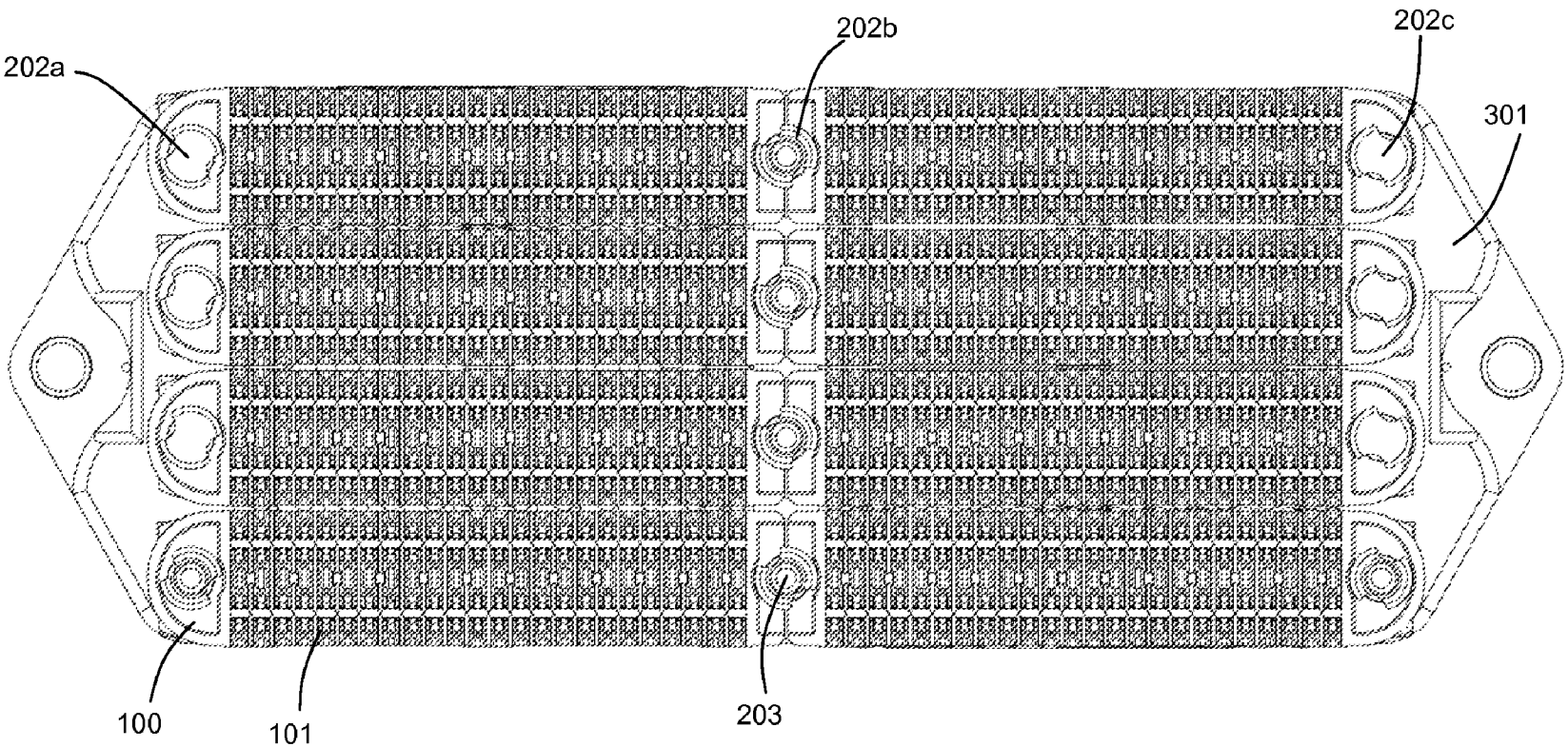
FIG. 5C is a bottom plan view of a high-density connector assembly according to a preferred embodiment of the present invention.

Each of the cables 108 in FIGS. 4, 5A, and 5B preferably includes a ground sheath 111 that is connected to a ground pad 112. It is possible to use cables that do not use a ground sheath 111. However, not having a ground sheath 111 would likely increase the cross-talk of the high-density connector assembly 300. The ends of the cables 108 that are not connected to the electrical lands 107 are connected to testing equipment (not shown).

FIG. 4 shows that the ground pad 112 is connected to the ground plane 113. However, it is possible that the ground pad 112 and ground plane 113 are not connected. Further, it is possible to locate the ground plane 113 within the circuit boards 104*a* and 104*b*.

Four connector sub-assemblies 200 are preferably used to form the high-density connector assembly 300. The high-density connector assembly 300 and the assembly of the high-density connector assembly 300 are discussed in detail below.

High-Density Connector Assembly

FIGS. 5A-5C show the high-density connector assembly 300 according to a preferred embodiment of the present invention. The high-density connector assembly 300 preferably includes four connector sub-assemblies 200 and a frame 301.

Four connector sub-assemblies 200 are connected to the frame 301. The ends of the pegs 201*a*, 201*b*, and 201*c* that are not connected to the connectors 100 are inserted into the holes 303*a*, 303*b*, and 303*c* in the frame 301 to secure the pegs 201*a*, 201*b*, and 201*c* in the frame 301. Pegs 201*a*, 201*b*, and 201*c* are preferably secured in the frame 301 such that the connector sub-assemblies 200 are field-replaceable. Thus, not only are the connectors 100 preferably field-replaceable, but also the connector sub-assemblies 200 are preferably field-replaceable.

In FIGS. 5A and 5B, the connector sub-assemblies 200 are held in the frame by screws 305. The pegs 201*a*, 201*b*, and 201*c* are inserted into the bottom of the frame 301, and the screws 305 are inserted into the frame 301 such that the screws 305 are located adjacent to the small diameter portion of the pegs 201*a*, 201*b*, and 201*c* and between the large diameter portion of the pegs 201*a*, 201*b*, and 201*c*. The pegs 201*a*, 201*b*, and 201*c* are prevented from being removed from the frame 301 by the engagement of the upper large diameter portion of the pegs 201*a*, 201*b*, and 201*c*. It is also possible to use other methods of securing the connector sub-assemblies 200 to the frame 301 to make the connector sub-assemblies 200 field-replaceable.

Preferably, the connector sub-assemblies 200 are held in the frame 301 such that the connector sub-assemblies 200 are allowed to float in the frame 301. Springs (not shown) are preferably used to provide a force in the direction extending away from the frame 301. It is also possible to use ball bearings placed at both ends of the springs in order to ensure a constant force is applied by the springs and to reduce unwanted torques applied by the springs to the pegs 201*a*, 201*b*, and 201*c* of the connector sub-assemblies 200.

Although FIGS. 5A-5C show the high-density connector assembly 300 having four connector sub-assemblies 200, it is possible that the high-density connector assembly 300 has a different number of connector sub-assemblies 200.

The frame 300 is preferably divided into four sections 304*a*, 304*b*, 304*c*, and 304*d* as shown in FIG. 5A. However, it is possible to divide the frame 300 into a different number of sections. In each of the four sections 304*a*, 304*b*, 304*c*, and 304*d*, cables 108 are grouped together. As shown in FIG. 5A, it is possible to tie the cables 108 grouped together in one of the four sections 304*a*, 304*b*, 304*c*, and 304*d* by a band 302. It is also possible to tie the cables 108 together by any other suitable method. This arrangement allows the high-density connector assembly 300 to have a compact design.

It should be understood that the foregoing description is only illustrative of preferred embodiments of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A high-density connector assembly comprising:
a frame;
at least one sub-assembly connected to the frame;
at least one connector connected to the at least one sub-assembly;
a plurality of contacts disposed in each of the at least one connector;
at least one circuit board disposed in each of the at least one connector and having a plurality of traces; and
a plurality of cables; wherein
each of the plurality of contacts includes a tail arranged to make contact with an electrical land and a head arranged to make contact with an electrical land; and
each of the plurality of cables is connected to a corresponding tail of one of the plurality of contacts through a corresponding electrical land connected to one of the plurality of traces.

2. A high-density connector assembly according to claim 1, wherein some of the plurality of contacts are connected to a ground plane provided in or on the at least one circuit board.

3. A high-density connector assembly according to claim 1, wherein at least one of the plurality of contacts has a bifurcated tip.

4. A high-density connector assembly according to claim 1, wherein the plurality of contacts are connected to the at least one circuit board.

5. A testing assembly comprising:
the high-density connector assembly according to claim 1; and
testing equipment connected to the high-density connector assembly.

6. A high-density connector assembly comprising:
a frame;
at least one sub-assembly connected to the frame;
at least one connector connected to the at least one sub-assembly;
a plurality of contacts disposed in each of the at least one connector;
at least one circuit board disposed in each of the at least one connector; and
a plurality of cables; wherein
each of the plurality of cables is connected to a corresponding one of the plurality of contacts;
the at least one sub-assembly includes at least one peg; and
the at least one connector is connected to the at least one peg by a fixing pin.

7. A high-density connector assembly according to claim 6, wherein the at least one peg is inserted into a corresponding at least one hole in the frame.

8. A high-density connector assembly according to claim 2, wherein the plurality of contacts is arranged in at least one row.

9. A high-density connector assembly according to claim 8, wherein, within each of the at least one row, one of the plurality of contacts that is connected to the ground plane is arranged between adjacent ones of the plurality of contacts that are connected to the corresponding one of the plurality of cables.

10. A high-density connector assembly comprising:
a frame;
at least one sub-assembly connected to the frame;
at least one connector connected to the at least one sub-assembly;
a plurality of contacts disposed in each of the at least one connector;
at least one circuit board disposed in each of the at least one connector; and
a plurality of cables; wherein
each of the plurality of cables is connected to a corresponding one of the plurality of contacts; and
the frame is divided into at least two sections, and the plurality of cables is divided into groups corresponding to the at least two sections.

11. A testing assembly according to claim 5, further comprising a mating circuit board arranged to be connected to a device to be tested and the high-density connector assembly.

12. A high-density connector assembly comprising:
a frame;
at least one sub-assembly connected to the frame;
at least one connector connected to the at least one sub-assembly;
a plurality of contacts disposed in each of the at least one connector;
at least one circuit board disposed in each of the at least one connector; and
a plurality of cables; wherein
each of the plurality of cables is connected to a corresponding one of the plurality of contacts; and
the at least one connector has a hole at one end and a slot at the other end; and
the at least one connector includes at least two connectors and an even number of connectors, and the even number of at least two connectors is arranged such that the slots of each of the even number of at least two connectors are directly adjacent each other.

13. A high-density connector assembly according to claim 1, wherein each of the at least one connector includes four rows of contacts.

14. A high-density connector assembly according to claim 13, wherein the at least one circuit board includes two circuit boards;
one of the two circuit boards is disposed between two of the four rows of contacts; and
the other of the two circuit boards is disposed between the other two of the four rows of contacts.

15. A high-density connector assembly according to claim 1, wherein the at least one sub-assembly includes four sub-assemblies, and the at least one connector includes two connectors.

16. A high-density connector assembly according to claim 1, wherein each of the plurality of cables is soldered to the at least one circuit board.

17. A high-density connector assembly according to claim 1, wherein each of the plurality of contacts includes a finger portion, and the finger portion of each of the plurality of contacts is arranged to contact the at least one circuit board.

18. A high-density connector assembly according to claim 1, wherein each of the plurality of cables includes a ground sheath.

* * * * *